US010566755B2

(12) United States Patent
Morris et al.

(10) Patent No.: US 10,566,755 B2
(45) Date of Patent: Feb. 18, 2020

(54) CRIMP TOOLING FOR TERMINAL CRIMPING MACHINE

(71) Applicant: TE CONNECTIVITY CORPORATION, Berwyn, PA (US)

(72) Inventors: Michael Morris, Harrisburg, PA (US); Christopher John Karrasch, Carlisle, PA (US)

(73) Assignee: TE Connectivity Corporation, Berwyn, PA (US)

( * ) Notice: Subject to any disclaimer, the term of this patent is extended or adjusted under 35 U.S.C. 154(b) by 268 days.

(21) Appl. No.: 15/496,526

(22) Filed: Apr. 25, 2017

(65) Prior Publication Data

US 2018/0309253 A1 Oct. 25, 2018

(51) Int. Cl.
*H01R 43/048* (2006.01)

(52) U.S. Cl.
CPC ..... *H01R 43/048* (2013.01)

(58) Field of Classification Search
CPC .... H01R 43/04; H01R 43/045; H01R 43/048; H01R 43/0486; H01R 43/05; H01R 43/055
See application file for complete search history.

(56) References Cited

U.S. PATENT DOCUMENTS 3,693,230 A * 9/1972 Morgan ..... H01R 4/20 29/753
4,064,624 A * 12/1977 Spangler ..... H01R 43/055 29/748
4,631,823 A * 12/1986 Collier ..... H01B 13/012 29/564.4
5,495,662 A * 3/1996 Nitta ..... H01R 43/052 29/753
5,727,409 A * 3/1998 Inoue ..... B30B 15/0094 29/709
5,887,469 A * 3/1999 Maeda ..... B30B 1/266 29/705
6,530,257 B2 * 3/2003 Ooji ..... H01R 43/055 29/753
7,024,752 B2 4/2006 Imgrut et al.
2003/0163916 A1 9/2003 Conte
2004/0007042 A1 1/2004 Imgrut et al.
2010/0139351 A1 * 6/2010 Bruhin ..... H01R 43/0486 72/21.4
2010/0212147 A1 8/2010 Malstrom

FOREIGN PATENT DOCUMENTS

EP 0687040 A2 12/1995
WO 1992002059 A1 * 2/1992

OTHER PUBLICATIONS

International Search Report, International Application No. PCT/IB2018/052362, International Filing Date Apr. 5, 2018.

* cited by examiner

*Primary Examiner* — Carl J Arbes

(57) ABSTRACT

Crimp tooling includes upper tooling for forming a terminal around a wire during crimping. The upper tooling includes a wire crimper and a wire crimper holder for holding the wire crimper. The wire crimper holder is removably coupled directly to a terminator ram of a terminal crimping machine and being driven by the terminator ram. The crimp tooling includes lower tooling assembly for supporting the terminal during crimping. The lower tooling assembly includes a base having a plate and an anvil supported by the plate. The base is removably coupled directly to the terminal crimping machine.

28 Claims, 9 Drawing Sheets

CRIMP TOOLING FOR TERMINAL CRIMPING MACHINE

BACKGROUND OF THE INVENTION

The subject matter herein relates generally to crimp tooling for terminal crimping machines for crimping electrical terminals to a wire.

Terminal crimping machines have long been used in the connector industry to effect high-speed mass termination of various cables. It is common practice for the terminal crimping machine to have an interchangeable tooling assembly called an applicator. In general, such terminal crimping machines are referred to as a terminator or press; however other types of terminal crimping machines may similarly be used, such as a lead maker or a bench machine. The applicator is typically mounted to a frame of the terminator. The applicator includes an applicator ram, which is operably coupled to a terminator ram of the terminator. The applicator holds crimp tooling, such as an anvil and a wire crimper, which is attached to the movable applicator ram. During crimping, the terminator ram moves the applicator ram, which moves the wire crimper relative to the anvil during a crimping stroke to crimp a terminal or connector to an end of a wire.

However, these known terminal crimping machines are not without disadvantages. For instance, the applicators are bulky having a housing that supports the crimp tooling and other components, such as a terminal guide. The housing occupies much of the space around the crimping zone making it difficult to place other components near the crimping zone, such as cameras or other sensors for monitoring the crimping process. Additionally, the applicators are expensive components to manufacture as the applicators are designed to have tight tolerances for locating the wire crimper relative to the anvil and to control the position of the wire crimper relative to the anvil during the crimp stroke.

A need remains for crimp tooling for use with a terminal crimping machine having improved functionality, that is less bulky and easily adaptable to different applications.

BRIEF DESCRIPTION OF THE INVENTION

In one embodiment, crimp tooling for a terminal crimping machine is provided for crimping a terminal to a wire that includes upper tooling for forming the terminal around the wire during crimping. The upper tooling includes a wire crimper and a wire crimper holder for holding the wire crimper. The wire crimper holder is removably coupled directly to a terminator ram of a terminal crimping machine and being driven by the terminator ram. The crimp tooling includes a lower tooling assembly for supporting the terminal during crimping. The lower tooling assembly includes a base having a plate and an anvil supported by the plate. The base is removably coupled directly to the terminal crimping machine.

In another embodiment, crimp tooling for a terminal crimping machine is provided for crimping a terminal to a wire that includes upper tooling for forming the terminal around the wire during crimping. The upper tooling includes a wire crimper having first and second legs provided on opposite sides of a crimp slot configured to receive the terminal and having a crimp profile configured to form the terminal during crimping. The wire crimper is movable along a crimping axis by a terminator ram of a terminal crimping machine. The crimp tooling includes a lower tooling assembly for supporting the terminal during crimping. The lower tooling assembly includes a base having a plate and an anvil supported by the plate. The plate has a front and a rear, and a first side and a second side. The anvil is fixed between the first and second sides. The base is coupled to a frame of the terminal crimping machine.

In a further embodiment, crimp tooling for a terminal crimping machine is provided for crimping a terminal to a wire that includes upper tooling for forming the terminal around the wire during crimping. The upper tooling includes a wire crimper and a wire crimper holder for holding the wire crimper. The wire crimper has first and second legs provided on opposite sides of a crimp slot configured to receive the terminal and having a crimp profile configured to form the terminal during crimping. The wire crimper is secured to the wire crimper holder. The wire crimper holder is configured to be releasably fixed to a terminator ram. The wire crimper holder is directly coupled to and driven by the terminator ram and is removable from the terminator ram. The wire crimper holder has a support member extending therefrom remote from the wire crimper. The crimp tooling includes a lower tooling assembly for supporting the terminal during crimping. The lower tooling assembly includes a base having a plate and an anvil supported by the plate. The base is removably coupled directly to a frame of the terminal crimping machine. The lower tooling assembly has a support member remote from the anvil that supports the upper tooling for storage of the upper tooling with the lower tooling after the wire crimper holder is removed from the terminator ram.

DETAILED DESCRIPTION OF THE INVENTION

Figure 1:
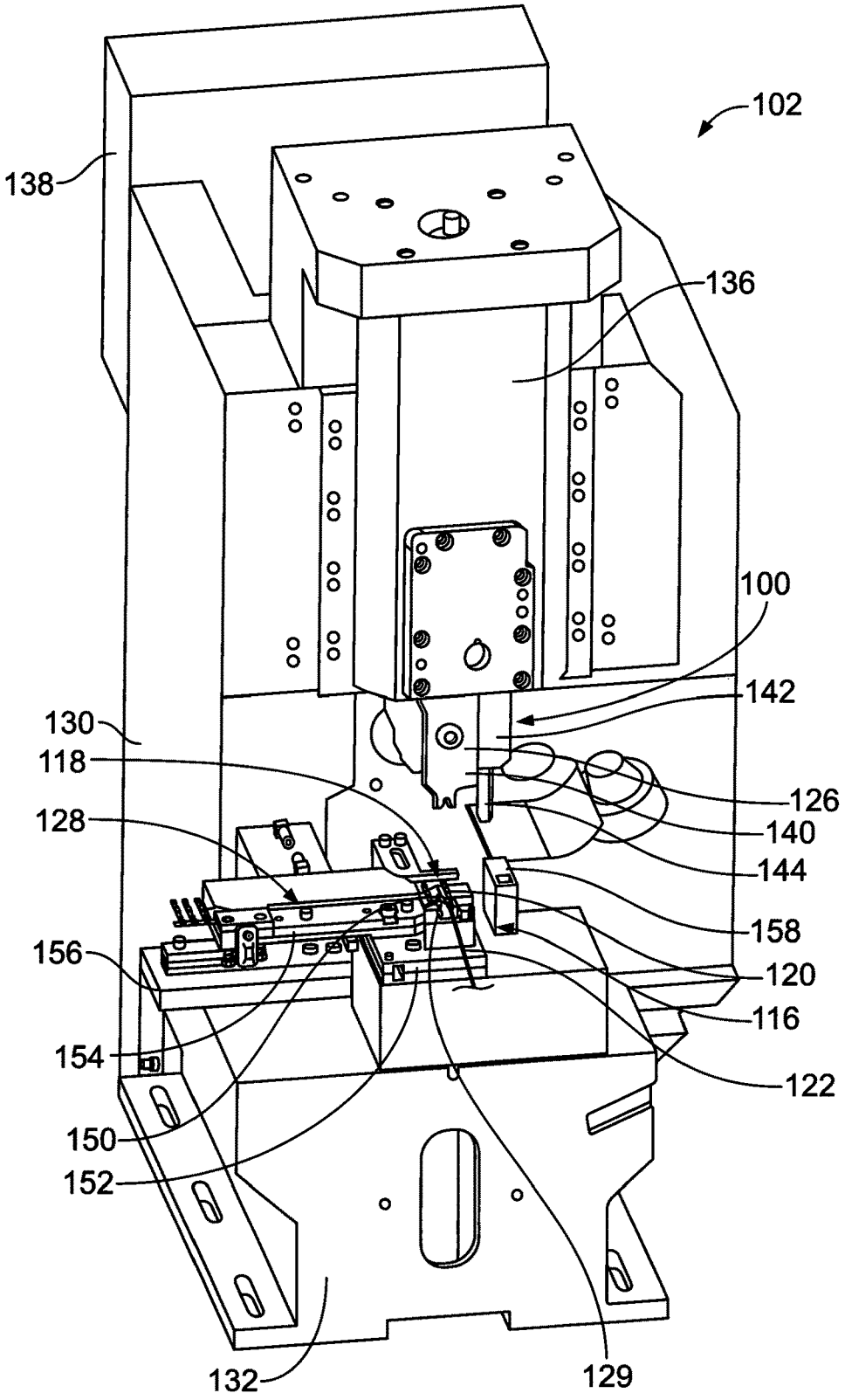
FIG. 1 is a front perspective view of the crimp tooling mounted in a terminal crimping machine in accordance with an exemplary embodiment.

FIG. 1 illustrates a terminal crimping machine 102 in accordance with an exemplary embodiment for crimping connectors or terminals to wires. In the illustrated embodiment, the terminal crimping machine 102 is a terminator; however, other types of terminal crimping machines may similarly be used, such as a bench machine, a lead maker, a press and the like. The terminal crimping machine 102 is used to terminate terminals 120 to wires 122. The terminal crimping machine 102 uses crimp tooling 100 to crimp the terminal 120 to the wire 122. For example, the crimp tooling 100 includes upper tooling 126 and a lower tooling assembly 128 having lower tooling 129. The terminal 120 and the wire 122 are crimped between the upper tooling 126 and the lower tooling 129. In an exemplary embodiment, the crimp tooling 100 is removably coupled to the terminal crimping machine 102. However, in alternative embodiments, the crimp tooling 100 may be non-removably coupled to the terminal crimping machine 102.

The terminal crimping machine 102 includes a terminator frame 130 and a base 132 at a bottom of the terminal crimping machine 102. The lower tooling assembly 128 may be supported by the base 132. Optionally, the lower tooling assembly 128 may be removable from the base 132. The terminator frame 130 supports a terminator ram 136 movable in a moving direction (for example, up and down). The terminator ram 136 supports the upper tooling 126, which is movable with the terminator ram 136 during crimping. The upper tooling 126 is supported without the need for a separate applicator or applicator ram as is typical in conventional terminal crimping machines. During operation, the terminator ram 136 is actuated or driven through a crimp stroke by a driving mechanism or actuator 138 of the terminal crimping machine 102. The crimp tooling 100 is coupled to the terminator ram 136 and is driven through the crimp stroke by the terminator ram 136, such as without the need for an intervening applicator and applicator ram as is common in conventional machines.

In an exemplary embodiment, the upper tooling 126 includes a wire crimper 140 and a wire crimper holder 142. The wire crimper 140 is configured to crimp the terminal 120 to the wire 122 during crimping. The wire crimper holder 142 is configured to be coupled to the terminator ram 136. In an exemplary embodiment, the upper tooling 126 includes a support member 144 extending from the wire crimper holder 142. The support member 144 is used to support the upper tooling 126 on the lower tooling assembly 128 when the upper tooling 126 is removed from the terminator ram 136. For example, the upper tooling 126 may be stored with the lower tooling assembly 128 when not in use and when removed from the terminator ram 136. The support member 144 engages the lower tooling assembly 128 and supports the upper tooling 126 on the lower tooling assembly 128, In an exemplary embodiment, the lower tooling 129 includes an anvil 150 supported by a base 152. The anvil 150 is used to support the terminal 120 during crimping. In an exemplary embodiment, the lower tooling assembly 128 includes a terminal guide 154 used to guide the terminals 120 to the crimping zone 118. The terminal guide 154 is supported by the base 152 and removable from the terminal crimping machine 102 with the base 152. In an exemplary embodiment, a feed mechanism 156 is provided for operating the terminal guide 154. The feed mechanism, in the illustrated embodiment, is coupled to the terminal crimping machine 102 and engages the terminal guide 154 when the lower tooling assembly 128 is coupled to the terminal crimping machine 102. The feed mechanism 156 remains with the terminal crimping machine 102 in an exemplary embodiment, the lower tooling assembly 128 includes a support member 158 coupled to the base 152. The support member 158 is used to support the upper tooling 126 when the upper tooling 126 is removed from the terminator ram 136, such as for storage of the upper tooling 126 with the lower tooling assembly 128. In the illustrated embodiment, the support member 158 is a block having an opening and the support member 144 is a post configured to be received in the opening of the support member 158. Other types of support members may be provided in alternative embodiments for securing the upper tooling 126 to the lower tooling assembly 128. For example, the support members may include clips, brackets, mounts or other types of support members.

During crimping, the terminator ram 136 is driven by the actuator 138. The wire crimper 140 of the upper tooling 126, which is coupled to the terminator ram 136, is driven with the terminator ram 136. The anvil 150 supports the terminal 120 and the wire 122 during the crimping process and the wire crimper 140 forms the terminal 120 around the wire 122 to mechanically and electrically connect the terminal 120 to the wire 122 during the crimping process. The wire crimper 140 is movable in an advancing direction and a retracting direction relative to the anvil 150 during the crimp stroke. The wire crimper 140 is driven through the crimp stroke from a released position at a top of the crimp stroke to the crimping position, such as through a bottom dead center position at a bottom of the crimp stroke, then returning to the released position. The crimp stroke has both an advancing or downward component and a return or upward component. Optionally, the wire crimper 140 may include both a conductor crimper for crimping the terminal 120 to the conductor of the wire 122 and an insulation crimper for crimping the terminal 120 to the insulation, such as the jacket, of the wire 122.

During operation, the wire crimper 140 is advanced downward toward the anvil 150 to an initial contact position, in which the wire crimper 140 initially contacts the terminal 120. The wire crimper 140 continues downward in the advancing direction to the bottom dead center position. As the wire crimper 140 is advanced from the initial contact position to the bottom dead center position, the wire crimper 140 moves through a crimp forming stage of the crimp stroke. The terminal 120 is formed around the wire 122 during the crimp forming stage. The crimp tooling 100 changes the shape of the terminal 120 around the wire 122 during the crimp forming stage. The crimping of the terminal 120 to the wire 122 occurs during the downward component of the crimp stroke. The wire crimper 140 then returns upward to the released position at the top of the crimp stroke. At some point during the releasing stage of the crimp stroke, the wire crimper 140 separates from the terminal 120, referred to as the separation position of the wire crimper 140. Due to the elastic nature of the metal material of the terminal 120 and the wire 122, the terminal 120 and the wire 122 have some slight spring back after the wire crimper 140 releases from the bottom dead center position. In the released position, the wire crimper 140 is positioned away from the anvil 150 and from the terminal 120.

Figure 2:
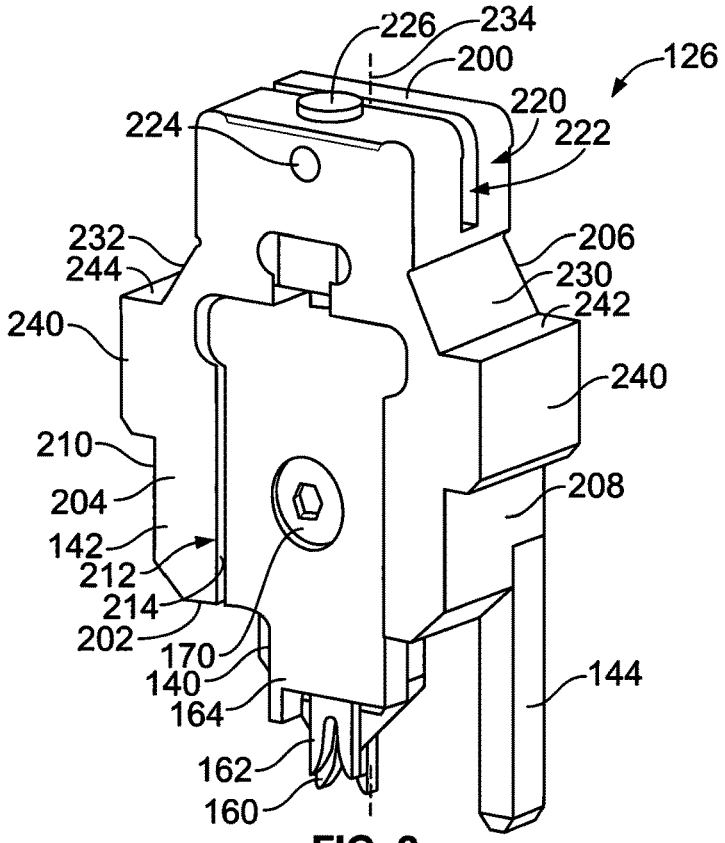
FIG. 2 is a perspective view of upper tooling in accordance with an exemplary embodiment.
Figure 3:
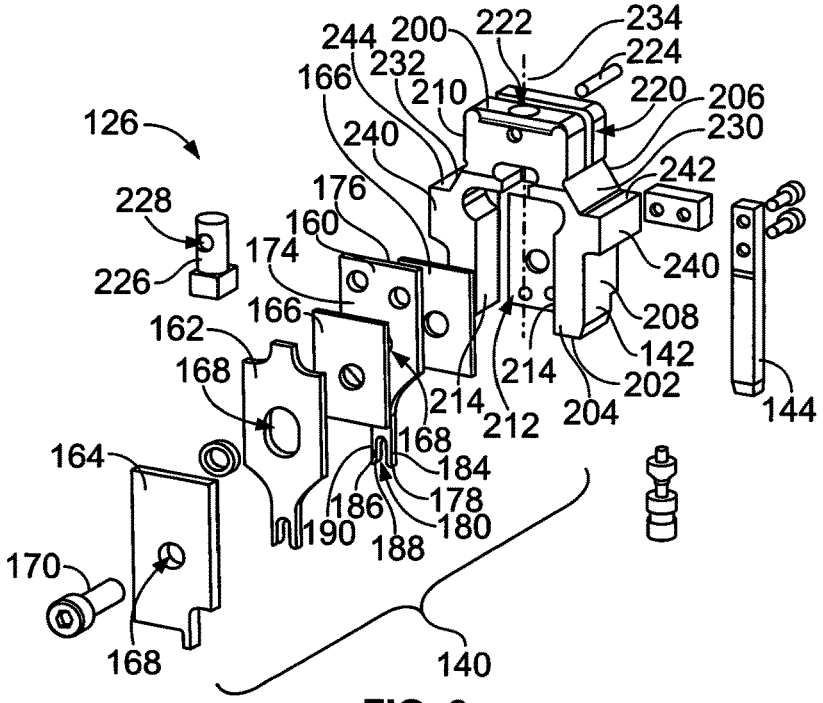
FIG. 3 is an exploded view of the upper tooling in accordance with an exemplary embodiment.

FIG. 2 is a perspective view of the upper tooling 126 of the crimp tooling 100 in accordance with an exemplary embodiment. FIG. 3 is an exploded view of the upper tooling 126 in accordance with an exemplary embodiment. The wire crimper 140 is held by the wire crimper holder 142.

In an exemplary embodiment, the wire crimper 140 includes a conductor crimper 160, an insulator crimper 162, a terminal shear depressor 164 and spacers 166 configured to be positioned between various components. The components include openings 168 that receive a fastener 170 for securing the wire crimper 140 to the wire crimper holder 142. Optionally, the openings 168 may be oblong to allow the conductor crimper 160 and/or the insulation crimper 162 to move vertically relative to the fastener 170, such as to control the crimp height of the wire crimper 140. For example, the conductor crimper 160 and/or the insulation crimper 162 may be moved up or down relative to the fastener 170 and the wire crimper holder 142 to adjust the vertical position of the crimping surfaces of the wire crimper 140, and thus adjust the crimp height. The conductor crimper 160 is used to crimp the terminal 120 to the conductor of the wire 122. The insulator crimper 162 is used to crimp the terminal 120 to the insulator of the wire 122, such as the jacket of the wire. The terminal shear depressor 164 is used to actuate the shear and separate the terminal 120 from the carrier strip for the terminals. In other various embodiments, the wire crimper 140 may include additional components or may include fewer components. For example, the wire crimper 140 may be limited to the conductor crimper 160 in various embodiments.

The conductor crimper 160 of the wire crimper 140 includes a main body 174 at a top 176 of the wire crimper 140 opposite a bottom 178 of the wire crimper 140. The main body 174 is configured to be coupled to the wire crimper holder 142. The opening 168 is provided in the main body 174 to receive the fastener 170 for securing the wire crimper 140 to the wire crimper holder 142. The conductor crimper 160 of the wire crimper 140 includes a crimp slot 180 having a crimp profile for forming the terminal 120 during crimping. The crimp slot 180 has a bell mouth open at the bottom 178 of the wire crimper 140. The crimp slot 180 defines a receiving space that receives the terminal 120. The bell mouth transitions outward as a lead-in to the crimp slot 180.

The crimp slot 180 is defined by first and second legs 184, 186 on opposite sides of the crimp slot 180. The legs 184, 186 have inner edges 188 that bound the crimp slot 180 and define the crimp profile at a top of the crimp slot 180. The legs 184, 186 have outer edges 190 opposite the inner edges 188. The inner edges 188 may generally face each other across the crimp slot 180 while the outer edges 190 may face away from each other.

The crimp profile of the crimp slot 180 forms the terminal 120 during crimping and defines the shape of the crimped terminal. For example, the inner edges 188 engage the walls of the terminal and form the walls against the crimp profile during the crimping process. The walls of the terminal 120 may be folded over during the crimping process and pressed into the wire 122. The crimp profile may be shaped to form an open barrel crimp, such as an F-crimp, along the terminal 120. In an exemplary embodiment, the inner edges 188 may be formed by an electric discharge machining (EDM) or a wire EDM process to define a precision crimp profile. The inner edges 188 may be formed by other removal processes, such as milling or grinding or by 3D printing or forging of the wire crimper 140.

The wire crimper holder 142 has a top end 200 and a bottom end 202, a front 204 and a rear 206, and a first side 208 and a second side 210. The wire crimper holder 142 has a pocket 212 at the bottom end 202 that receives the wire crimper 140. For example, the main bodies 174 are received in the pocket 212 and secured in the pocket 212 using the fastener 170. In an exemplary embodiment, the pocket 212 is open at the bottom end 202 such that the wire crimper 140 extends below the wire crimper holder 142 for engaging the terminal 120 during crimping. Optionally, the pocket 212 may be open at the front 204 for loading the wire crimper 140 into the pocket 212. The pocket 212 is sized and shaped to receive the wire crimper 140. In an exemplary embodiment, the pocket 212 includes pocket walls 214 that limit movement (for example, rotation) of the wire crimper 140 in the pocket 212. The pocket walls 214 may generally fix the position of the wire crimper 140 in the wire crimper holder 142.

The wire crimper holder 142 includes a plug 220 at the top end 200. The plug 220 is configured to be loaded into the terminator ram 136 (shown in FIG. 1). In the illustrated embodiment, the plug 220 is generally box-shaped. The plug 220 is defined by the top end 200, the front 204 and the rear 206 and defines portions of the first and second sides 208, 210. In an exemplary embodiment, the plug 220 includes a slot 222 open at the top end 200. The plug 220 includes a latching element 224 received in the plug 220. In the illustrated embodiment, the latching element 224 is a latching pin that spans across the slot 222. Other types of latching elements may be used in alternative embodiments. In the illustrated embodiment, a fastener 226 having an opening 228 is configured to be received in the plug 220 to receive the latching element 224. For example, the latching element 224 is received in the opening 228. Optionally, the opening 228 is oblong to allow the fastener 226 to move vertically relative to the latching element 224, such as to control the crimp height of the insulation crimper 162. For example, the fastener 226 may be moved up or down relative to the wire crimper holder 142 to adjust the vertical position of the insulation crimper 162 within the wire crimper holder 142.

The wire crimper holder 142 includes first and second alignment surfaces 230, 232. The alignment surfaces 230, 232 are provided along the plug 220 and are used to locate the wire crimper holder 142 in the terminator ram 136. For example, the first and second alignment surfaces 230, 232 engage the terminator ram 136 to hold a side-to-side position of the wire crimper holder 142 relative to the terminator ram 136. The positions of the alignment surfaces 230, 232 may also control the crimp height of the upper tooling 126. For example, by controlling the relative positions between the alignment surfaces 230, 232 and the mounting location of the wire crimper 140 (for example, the mounting location of the fastener 170), the position of the wire crimper 140 relative to the terminator ram 136, and thus the crimp height, may be controlled. In various applications, different wire crimper holders 142 may be provided having different relative locations of the alignment surfaces 230, 232 (for example, located at different vertical heights), whereby, depending on which wire crimper holder 142 is selected and used with the wire crimper 140, the crimp height of the upper tooling 126 may be controlled. In the illustrated embodiment, the first and second alignment surfaces 230, 232 are nonparallel. For example, the first and second alignment surfaces 230, 232 are angled relative to a crimping axis 234 of the upper tooling 126. In the illustrated embodiment, the first and second alignment surfaces 230, 232 are angled such that the alignment surfaces 230, 232 face generally outward and upward. Optionally, the alignment surfaces 230, 232 may include notches, bumps, channels, openings, protrusions or other features for keying the wire crimper holder 142 relative to the terminator ram 136.

The wire crimper holder 142 includes press flanges 240 extending from the first and second sides 208, 210. The press flanges 240 define shoulders for the terminator ram 136 to press against during the crimping process. The press flanges 240 include first and second press surfaces 242, 244 against which the terminator ram 136 presses during the crimping process. In the illustrated embodiment, the first and second press surfaces 242, 244 are upward facing; however, the press surfaces 242, 244 may have any orientation relative to the crimping axis 234 in alternative embodiments. The press surfaces 242, 244 are configured to engage the terminator ram 136 and are configured to be pressed downward by the terminator ram 136 during crimping. In an exemplary embodiment, the plug 220 is defined above the press surfaces 242, 244. Optionally, the alignment surfaces 230, 232 may extend upward from the press surfaces 242, 244, respectively.

In an exemplary embodiment, the support member 144 is configured to be coupled to the wire crimper holder 142. For example, the support member 144 may be coupled to the rear 206 using fasteners. Optionally, the support member 144 may be coupled to the wire crimper holder 142 offset from the wire crimper 140, such as at or near the first side 208.

Figure 4:
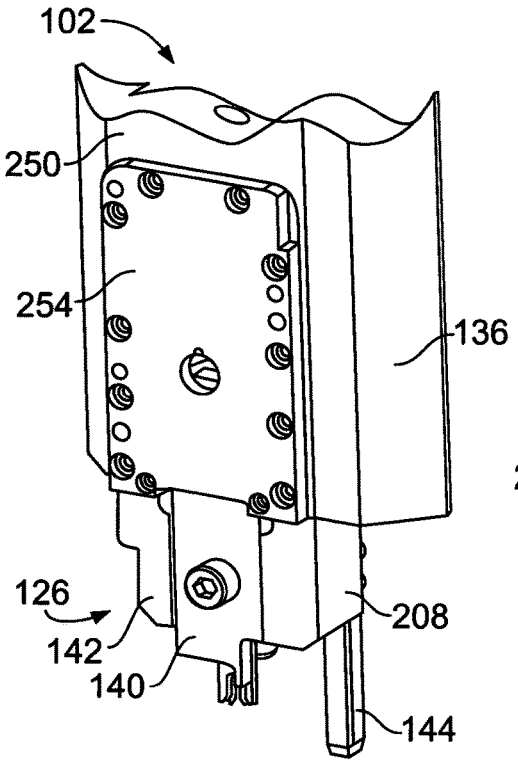
FIG. 4 is a front perspective view of a portion of the terminal crimping machine showing the upper tooling coupled to a terminator ram.
Figure 5:
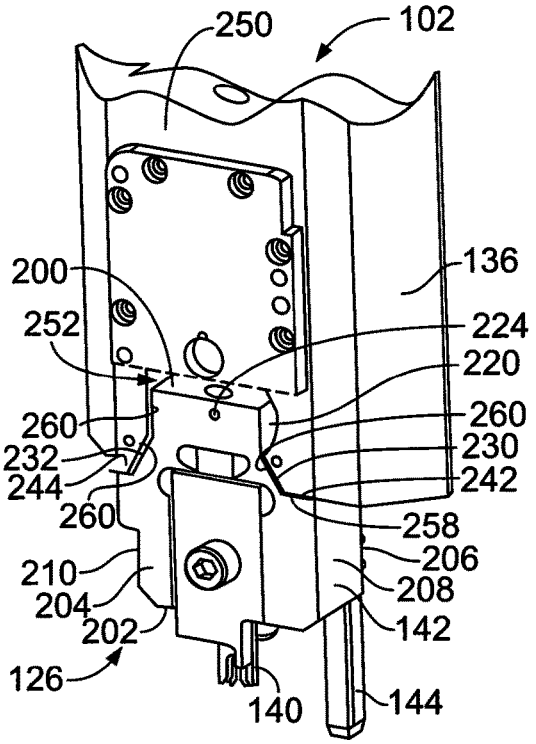
FIG. 5 is a front perspective view of a portion of the terminal crimping machine showing the upper tooling coupled to the terminator ram.
Figure 6:
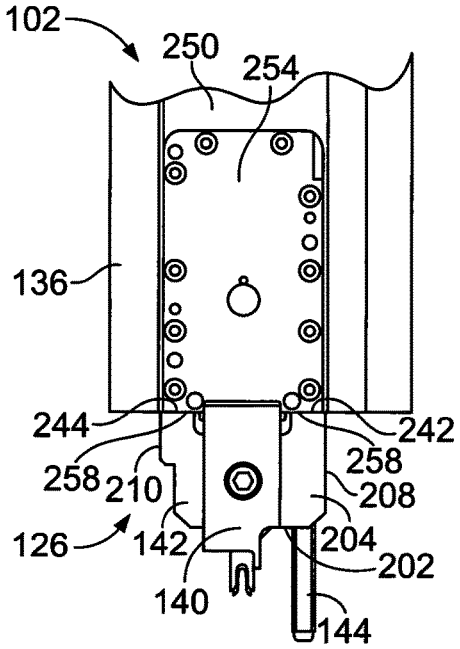
FIG. 6 is a front view of a portion of the terminal crimping machine showing the upper tooling coupled to the terminator ram.
Figure 7:
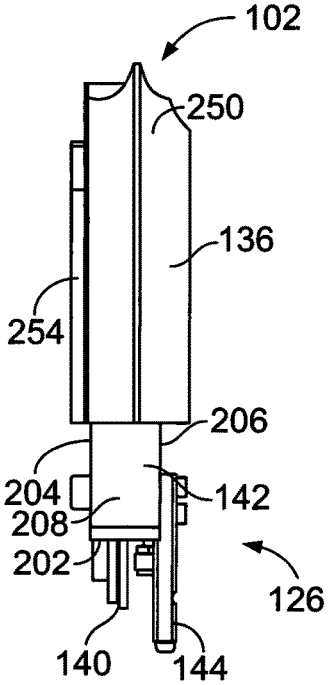
FIG. 7 is a side view of a portion of the terminal crimping machine showing the upper tooling coupled to the terminator ram.

FIG. 4 is a front perspective view of a portion of the terminal crimping machine 102 showing the upper tooling 126 coupled to the terminator ram 136. FIG. 5 is a front perspective view of a portion of the terminal crimping machine 102 with a portion of the cover removed to show the upper tooling 126 coupled to the terminator ram 136. FIG. 6 is a front view of a portion of the terminal crimping machine 102 showing the upper tooling 126 coupled to the terminator ram 136. FIG. 7 is a side view of a portion of the terminal crimping machine 102 showing the upper tooling 126 coupled to the terminator ram 136.

Terminator ram 136 includes a body 250 having a plug chamber 252 (FIG. 5) that receives the plug 220 of the wire crimper holder 142. Optionally, a cover 254 (FIG. 4) closes the plug chamber 252. The plug chamber 252 is sized and shaped to receive the plug 220. The wire crimper holder 142 is configured to be releasably coupled to the terminator ram 136, such as using the latching element 224.

The bottom end 202 of the wire crimper holder 142 extends below a bottom 258 of the terminator ram 136. The bottom 258 engages the press surfaces 242, 244 for pressing the upper tooling 126 downward during crimping. The wire crimper 140 extends below the wire crimper holder 142 and the terminator ram 136 to engage the terminal during the crimping process. The plug chamber 252 includes alignment surfaces 260 for positioning the plug 220 in the plug chamber 252. For example, the alignment surfaces 260 may engage the alignment surfaces 230, 232 of the wire crimper holder 142. Other alignment surfaces 260 may engage other portions of the wire crimper holder 142, such as the top end 200, the front 204, the rear 206, the first side 208 and/or the second side 210. The alignment surfaces 260 position the wire crimper holder 142, and thus the wire crimper 140, relative to the terminator ram 136. For example, the alignment surfaces 260 hold the side to side position of the wire crimper holder 142. By having the alignment surfaces 230, 232 of the wire crimper holder 142 directly engage the terminator ram 136, the position of the wire crimper holder 142 may be precisely controlled and maintained relative to the terminator ram 136. As such, the position of the wire crimper 140 relative to the lower tooling assembly 128 (shown in FIG. 1) is unchanged during the crimping process. Having few components between the wire crimper 140 and the terminator ram 136 allows for tight or tolerance control of the position of the wire crimper 140. For example, by eliminating the applicator and the movable components of the applicator as well as the interfaces between the wire crimper 140 and the applicator and between the applicator and the terminator ram 136, positioning is better controlled and the terminal crimping machine 102 is less expensive as compared to systems that use an applicator.

The support member 144 is shown extending from the wire crimper holder 142. The support member 144 is fixed to the wire crimper holder 142. When the upper tooling 126 is released from the Terminator ram 136, the upper tooling 126 may be stored with the lower tooling assembly 128 (shown in FIG. 1) using the support member 144. For example, the support member 144 may interface with the support member 158 (shown in FIG. 1) to couple the upper tooling 126 to the lower tooling assembly 128 for storage. After the upper tooling 126 is removed from the terminator ram 136, a different upper tooling may be coupled to the terminator ram 136.

Figure 8:
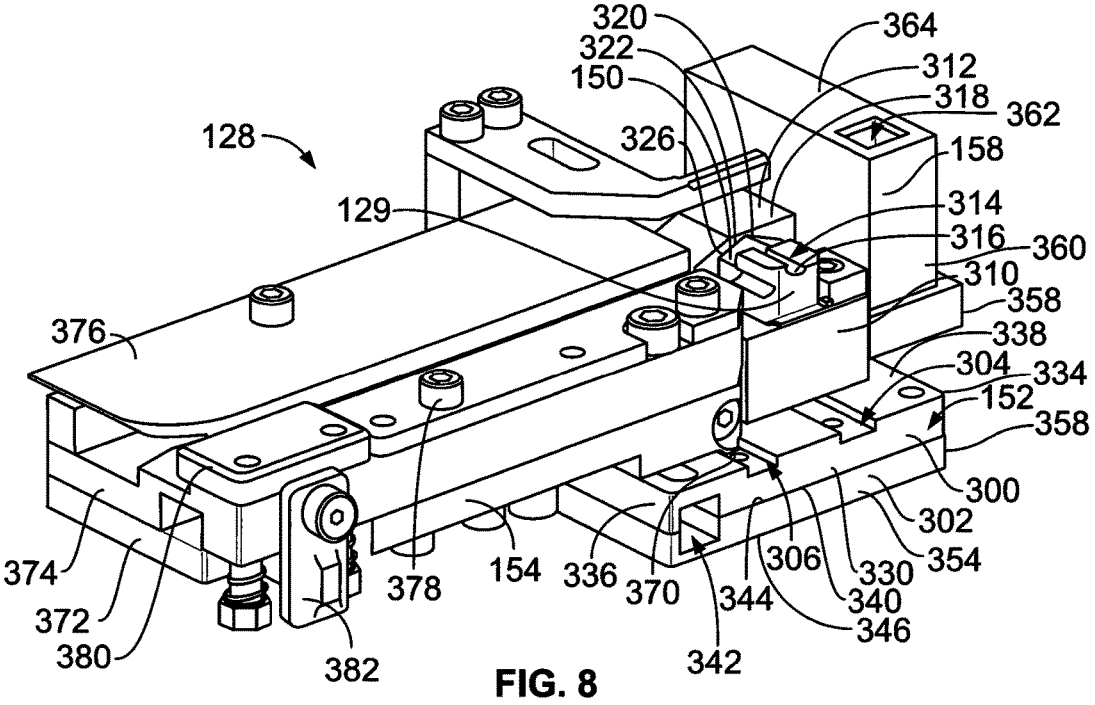
FIG. 8 is a perspective view of lower tooling assembly for the termination tool in accordance with an exemplary embodiment.
Figure 9:
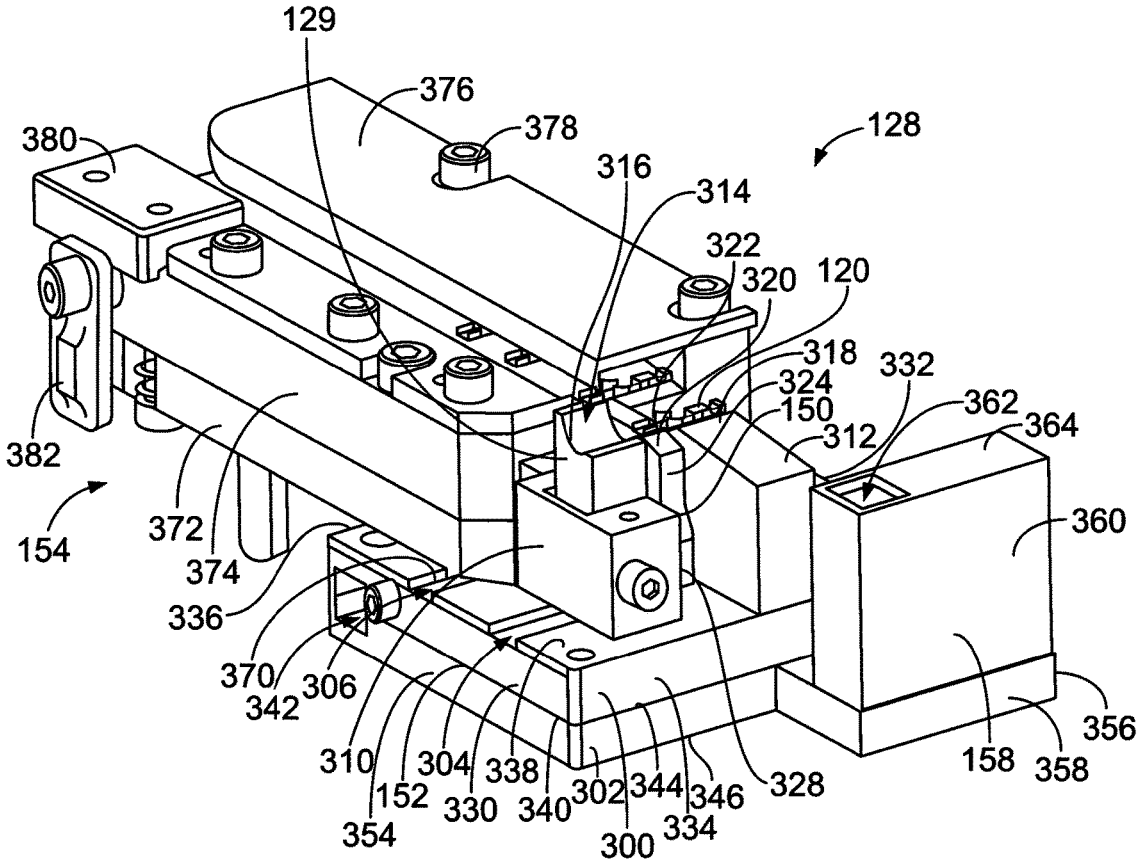
FIG. 9 is a front perspective view of the lower tooling assembly in accordance with an exemplary embodiment.
Figure 10:
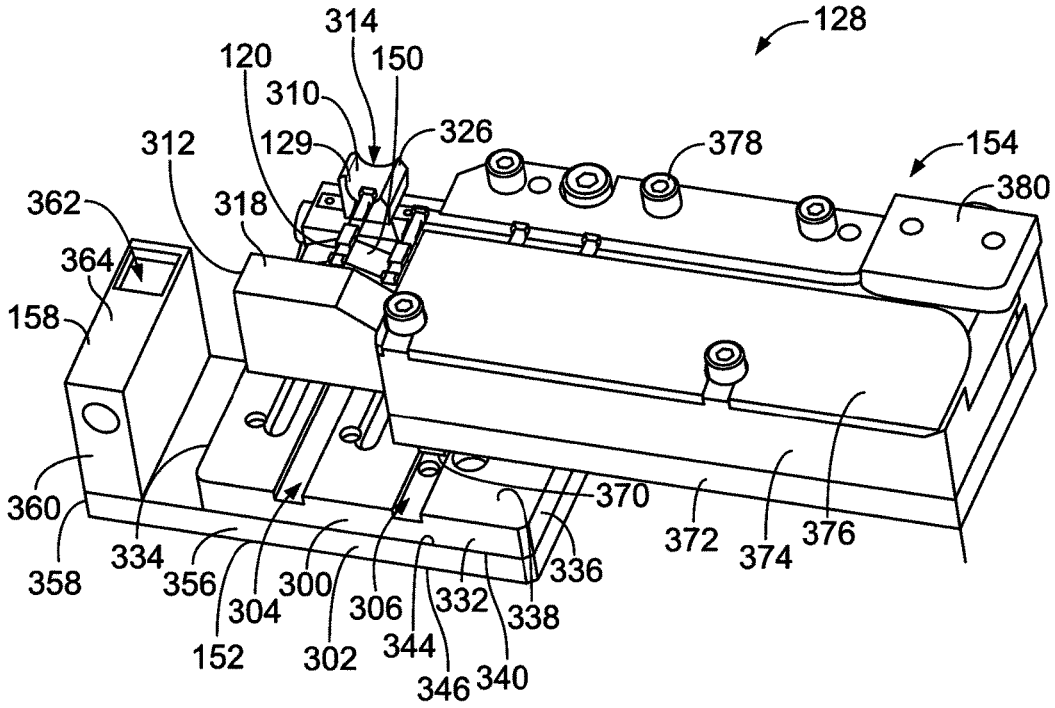
FIG. 10 is a rear perspective view of the lower tooling assembly in accordance with an exemplary embodiment.

FIG. 8 is a front perspective view of the lower tooling assembly 128 in accordance with an exemplary embodiment. FIG. 9 is a front perspective view of the lower tooling assembly 128 in accordance with an exemplary embodiment. FIG. 10 is a rear perspective view of the lower tooling assembly 128 in accordance with an exemplary embodiment. The lower tooling assembly 128 includes the lower tooling 129, the terminal guide 154 and the support member 158.

The base 152 includes one or more plates used to support the components thereof, such as the anvil 150, the terminal guide 154, and the support member 158. For example, in the illustrated embodiment, the base 152 includes an upper plate 300 and a lower plate 302. The components may be attached to the plates 300, 302 using fasteners.

In the illustrated embodiment, the upper plate 300 includes positioning slots 304, 306 for positioning the anvil 150 and the terminal guide 154, respectively. The positioning slots 304, 306 may control the side-to-side positioning of the components while the fasteners are used to secure the components to the plates 300, 302.

In an exemplary embodiment, the lower tooling 129 includes the anvil 150, a wire support 310 and a terminal support 312 mounted to the upper plate 300 adjacent the anvil 150. For example, the wire support 310 is positioned forward of the anvil 150 and the terminal support 312 is mounted rearward of the anvil 150. The wire support 310 includes a cradle 314 at a top 316 of the wire support 310 for supporting the wire 122, such as for positioning the wire 122 in the crimp barrel of the terminal 120. The terminal support 312 includes a support surface 318 at a top of the terminal support 312 for supporting the terminal 122 adjacent the anvil 150. Optionally, the anvil 150 may be coupled to the wire support 310 and/or the terminal support 312. Alternatively, the anvil 150 may be directly coupled to the plate 300 using a fastener through the plate 300.

The anvil 150 includes a cradle 320 and a top 322 of the anvil 150. The cradle 320 is used to support a portion of the terminal during crimping, such as the crimp barrel. The terminal 120 is pressed against the cradle 320 during the crimping process. Optionally, the cradle 320 may be concave; however, the cradle 320 may be flat or convex in alternative embodiments. The anvil 150 includes sides 324, 326 extending from the cradle 320 to a base 328 of the anvil 150. The base 328 is configured to be coupled to the plate 300. The sides 324, 326 are configured to be received in the crimp slot 180 (shown in FIG. 4) when the wire crimper 140 is lowered onto the anvil 150.

The upper plate 300 includes a front 330 and a rear 332 opposite the front 330. The upper plate 300 includes a first side 334 and a second side 336 opposite the first side 334. The upper plate 300 includes a top 338 and the bottom 340 opposite the top 338. The lower plate 302 is coupled to the bottom 340 of the upper plate 300. In an exemplary embodiment, the positioning slots 304, 306 are provided at the top 338 of the upper plate 300. The positioning slots 304, 306 are open at the top 338. Optionally, the positioning slots 304, 306 may be open at the front 330 and/or the rear 332. The positioning slots 304, 306 may extend parallel to each other. The positioning slots 304, 306 may be parallel to the first and/or second sides 334, 336.

In an exemplary embodiment, the anvil 150 is coupled to the top 338 of the upper plate 300 and a portion of the anvil 150 extends into the positioning slot 304. While other portions of the base 328 of the anvil 150 rest on the top 338. For example, the anvil 150 includes a protrusion that extends into the positioning slot 304. The protrusion may be loaded into the positioning slot 304 through the top 338 and/or through the front 330 and/or the rear 332. Optionally, the positioning slot 304 may be a T slot that captures the anvil 150 therein. For example, the protrusion on the anvil 150 may be T-shaped and loaded into the T-shaped positioning slot 304 through the front 330 and/or the rear 332. The anvil 150 may be variably positionable within the positioning slot 304 by moving the anvil 150 in the positioning slot 304 to the desired location relative to the front 330 and the rear 332. When the protrusion of the anvil 150 is in the positioning slot 304, the anvil 150 is restricted from moving side to side. The upper plate 300 holds the side to side position of the anvil 150 relative to the upper plate 300. In an exemplary embodiment, once the anvil 150 is located front to rear, a fastener may be used to secure the position of the anvil 150 relative to the upper plate 300. In alternative embodiments, the wire support 310 and/or the terminal support 312 may be used to position and/or secure the anvil 150 relative to the upper plate 300. For example, the wire support 310 may block forward movement of the anvil 150 while the terminal support 312 blocks rearward movement of the anvil 150.

Optionally, the upper plate 300 may include slots along the bottom 340. Such slots may receive fasteners or other components. In an exemplary embodiment, the lower plate 302 includes slots 342 therein, such as in a top 344 and/or a bottom 346 of the lower plate 302. The upper plate 300 and/or the lower plate 302 are configured to be secured to the terminal crimping machine 102, such as using a fastener or other component.

In the illustrated embodiment, the support member 158 is coupled to the lower plate 302 of the base 152. The support member 158 may be coupled to other portions of the base 152 in alternative embodiments. The support member 158 is provided at the first side 358. In an exemplary embodiment, the support member 158 includes a housing 360 and an opening 362 open at a top 364 of the housing 360. In the illustrated embodiment, the opening 362 is rectangular shaped; however, the opening 362 may have other shapes in alternative embodiments. The shape of the opening 362 corresponds to a shape of the support member 144 of the upper tooling 126 (both shown in FIG. 4).

The terminal guide 154 is coupled to the base 152. In an exemplary embodiment, the terminal guide 154 includes a positioning tab 370 extending therefrom configured to be received in the positioning slot 306 to position the terminal guide 154 relative to the anvil 150. When the positioning tab 370 is received in the positioning slot 306, the terminal guide 154 is restricted from moving side to side relative to the base 152. Optionally, the positioning tab 370 may be slid forward or rearward within the positioning slot 306 to align the terminal guide 154 relative to the anvil 150. Once positioned, the terminal guide 154 may be secured using fasteners. Other types of locating features may be used in alternative embodiments.

In an exemplary embodiment, the terminal guide 154 includes a guide mount 372, a guide base 374 coupled to the guide mount 372, and a guide cover 376 coupled to the guide base 374. The guide mount 372 is configured to be mounted to the base 152. For example, the positioning tab 370 extends from a bottom of the guide mount 372. Fasteners may secure the guide mount 372 to the base 152. The guide base 374 and/or the guide cover 376 may be secured using fasteners 378. The guide base 374 supports the strip of terminals 122 as the terminals 122 are advanced to the anvil 150 for crimping. The guide base 374 may guide the strip of terminals during feeding. The guide cover 376 covers the strip of terminals as the terminals are advanced. The guide cover 376 may protect the terminals as the terminals are advanced. The guide cover 376 may be used to position the terminals relative to the guide base 374. In an exemplary embodiment, the terminal guide 154 includes a terminal drag 380 engaging the strip of terminals to limit advancing of the terminals. A drag release 382 may be used to control tension of the terminal drag 380 on the strip of terminals and/or to release the terminal drag 380 from the strip or terminals.

Figure 11:
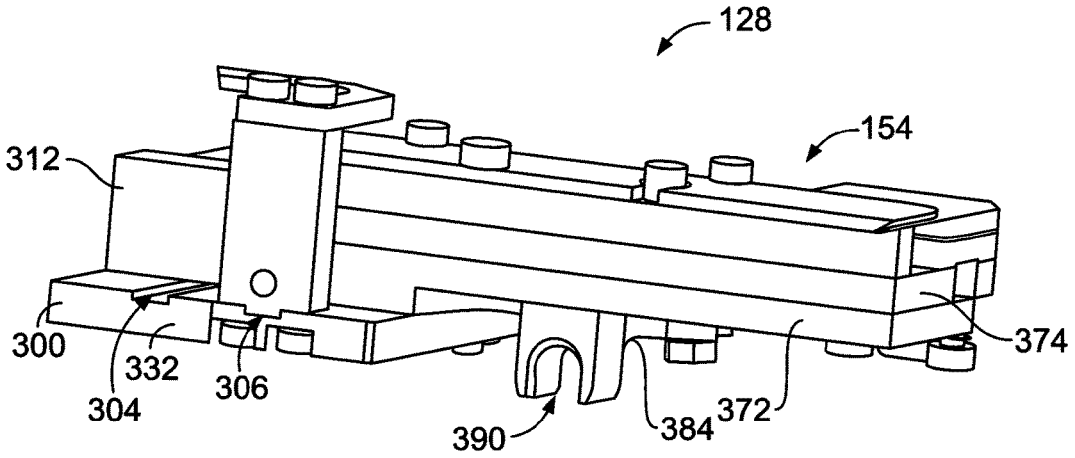
FIG. 11 is a rear perspective view of a portion of the lower tooling assembly in accordance with an exemplary embodiment.
Figure 12:
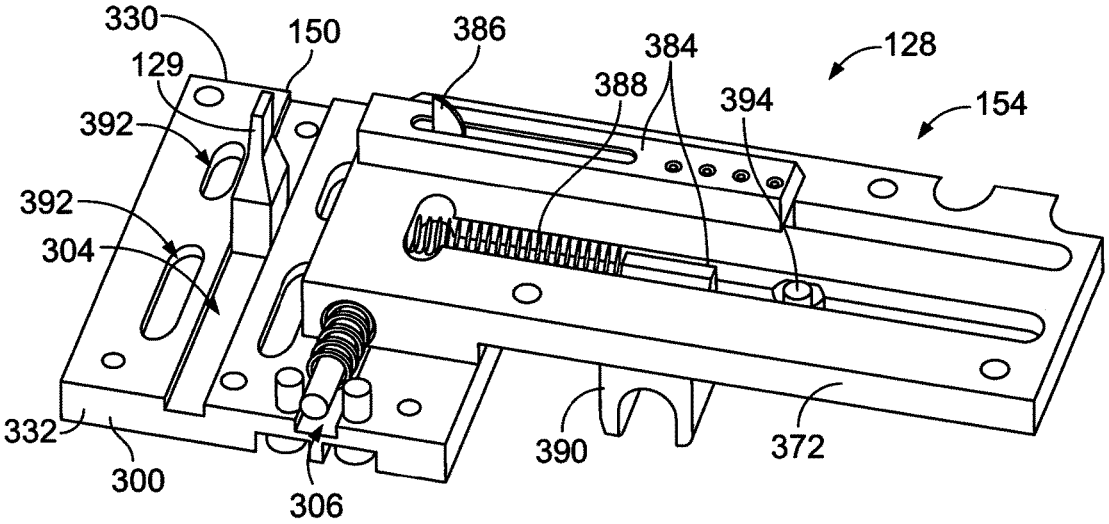
FIG. 12 is a top perspective view of a portion of the lower tooling assembly in accordance with an exemplary embodiment.
Figure 13:
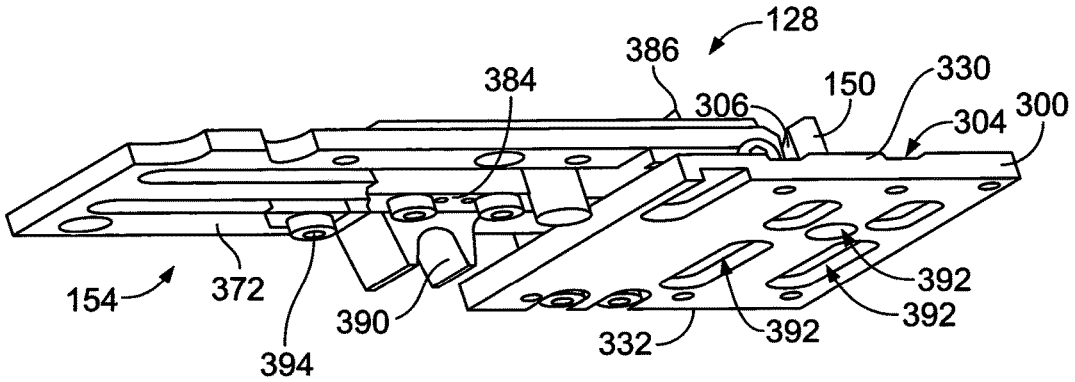
FIG. 13 is a bottom perspective view of a portion of the lower tooling assembly in accordance with an exemplary embodiment.

FIG. 11 is a rear perspective view of a portion of the lower tooling assembly 128 in accordance with an exemplary embodiment. FIG. 12 is a top perspective view of a portion of the lower tooling assembly 128 with the guide cover 376 and guide base 374 removed in accordance with an exemplary embodiment. FIG. 13 is a bottom perspective view of the portion of the lower tooling assembly 128 as shown in FIG. 12 in accordance with an exemplary embodiment.

The terminal guide 154 includes a feed slide 384 slidably coupled to the guide mount 372 and/or the guide base 374. The feed slide 384 is movable in a feed direction to advance the terminals. The feed slide 384 includes a feed finger 386 configured to engage the terminal strip to advance the terminals. Optionally, the feed finger 386 may be pivotably coupled to the feed slide 384 such that the feed finger 386 may be disengaged from the terminal strip during retracting of the feed slide 384. In an exemplary embodiment, the terminal guide 154 includes a return spring 388 engaging the feed slide 384 to return the feed slide 384 to a retracted position. In the illustrated embodiment, the feed slide 384 includes a mounting bracket 390 for engaging the feed mechanism 156 (shown in FIG. 1). The feed mechanism 156 is used to actuate or advance the feed slide 384 within the terminal guide 154. In an exemplary embodiment, the mounting bracket 390 is provided at the bottom of the terminal guide 154 to engage the feed mechanism 156. In an exemplary embodiment, the feed slide 384 is configured to be positioned below the terminal strip such that the feed finger 386 engages the terminal strip from below. In an exemplary embodiment, the terminal guide 154 includes a feed stop 394 providing a hard stop for the feed slide 384. For example, the mounting bracket 390 may be blocked by the feed stop 394 as the feed slide 384 is retracted. The feed stop 394 provides adjustment for the location of the mounting bracket 390 thereby locating the feed mechanism 156 on the terminal guide 154. In an exemplary embodiment, the feed stop 394 may be variably positionable along the guide mount 372. For example, the feed stop 394 may be mounted at various positions along the guide mount 372 to change the retraction depth of the feed slide 384. The position of the feed stop 394 may coincide with the design of the terminals such that the feed finger 386 returns to the appropriate position to pick up and advance the next terminal.

FIG. 12 illustrates the guide mount 372 positioned in the positioning slot 306. FIG. 12 also illustrates the anvil 150 positioned in the positioning slot 304. Optionally, the feed slide 384 may be generally aligned (for example, the front to rear) with the anvil 150. In an exemplary embodiment, the upper plate 300 includes fastener openings 392 therethrough. The fastener openings 392 to receive fasteners used to secure components to the upper plate 300, such as the wire support 310, the terminal support 312 and the like. Optionally, the fastener openings 392 may be elongated between the front 330 and the rear 332 to allow the components to be variably positionable along the upper plate 300. As such, the mounting location of the various components may be adjusted depending on the particular application. In such manner, the upper plate 300 may be modularly designed for multiple applications by interchanging the various components, such as the anvil 150, the wire support 310, the terminal support 312, the terminal guide 154, and the like by providing the positioning slots 304, 306 and the fastener openings 392 to accommodate various positions of the components.

Figure 14:
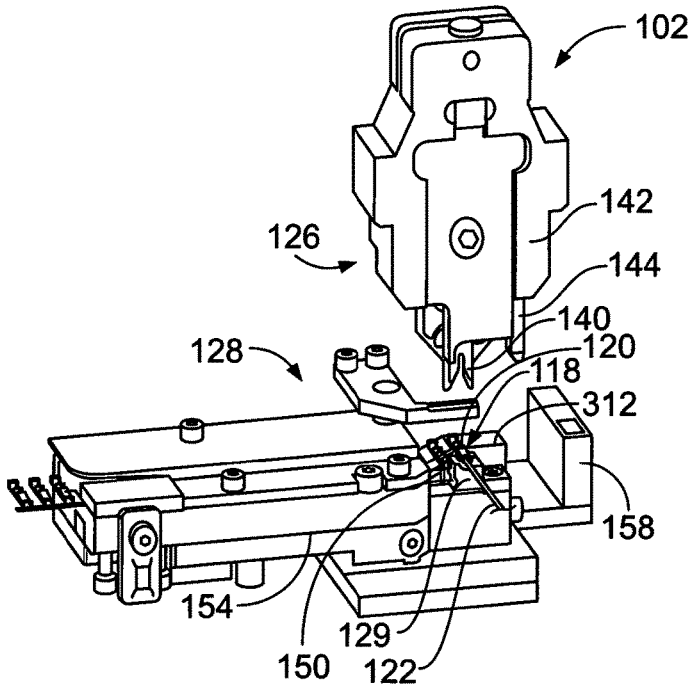
FIG. 14 illustrates the upper tooling positioned relative to the lower tooling assembly in a retracted position.

FIG. 14 illustrates the upper tooling 126 positioned relative to the lower tooling assembly 128 in a retracted position. The terminator frame 130 and the terminator ram 136 (both shown in FIG. 1) are removed for clarity. The wire crimper holder 142 holds the wire crimper 140 above the anvil 150. The anvil 150 and the terminal support 312 support the terminal 120 during the crimping process. The terminal guide 154 feeds the terminals 120 into the crimping zone 118. The upper tooling 126 is advanced toward the lower tooling assembly 128 during the crimping process to crimp the terminal 120 to the wire 122. Upon completion of use of the terminal crimping machine 102 or when different tooling is selected to be used on the terminal crimping machine 102, the upper tooling 126 may be removed from the terminator ram 136 and stored with the lower tooling assembly 128. For example, the support member 144 may be coupled to the support member 158 to secure the upper tooling 126 to the lower tooling assembly 128 for storage.

Figure 15:
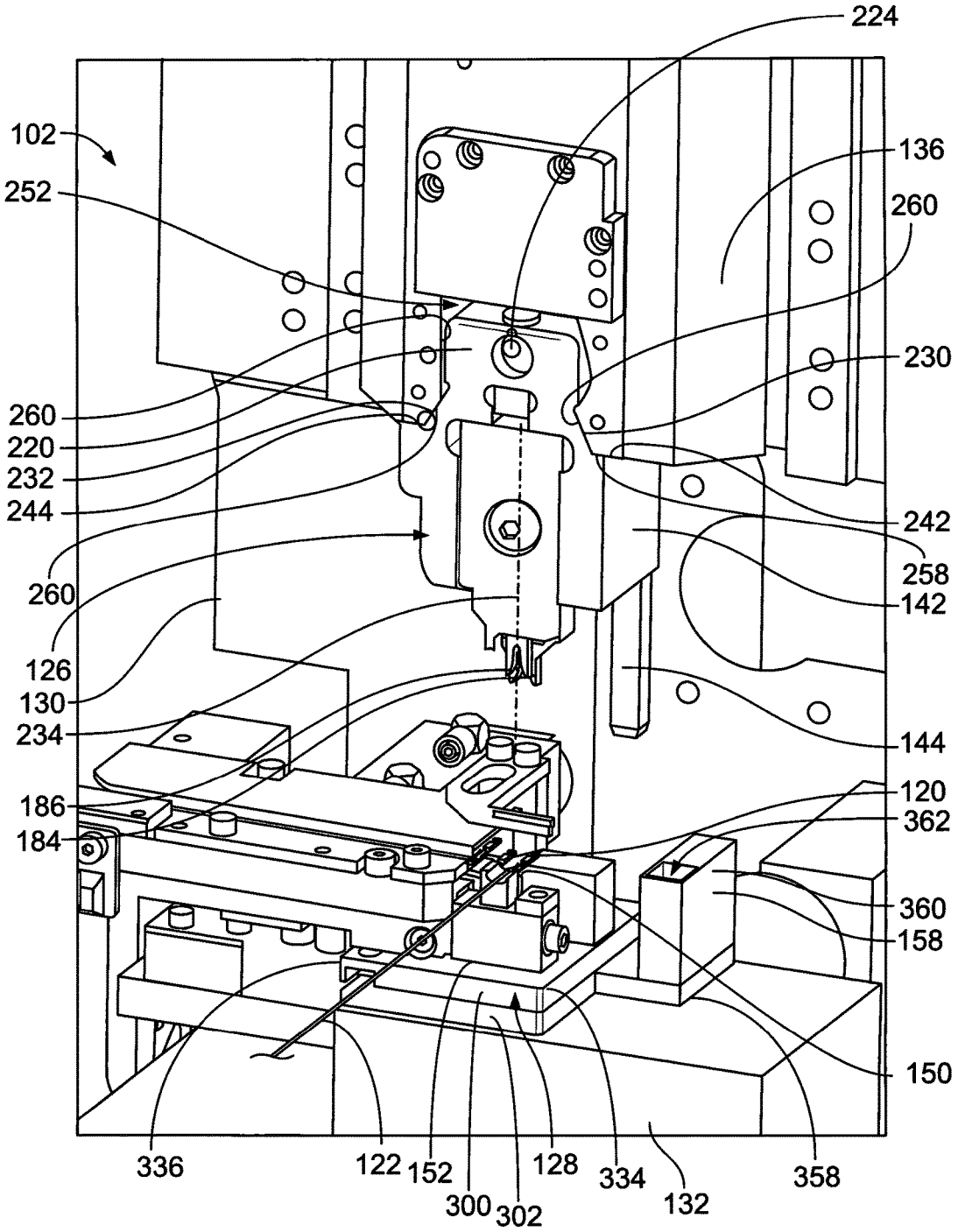
FIG. 15 illustrates a portion of the terminal crimping machine showing the upper tooling positioned relative to the lower tooling assembly in a retracted position.
Figure 16:
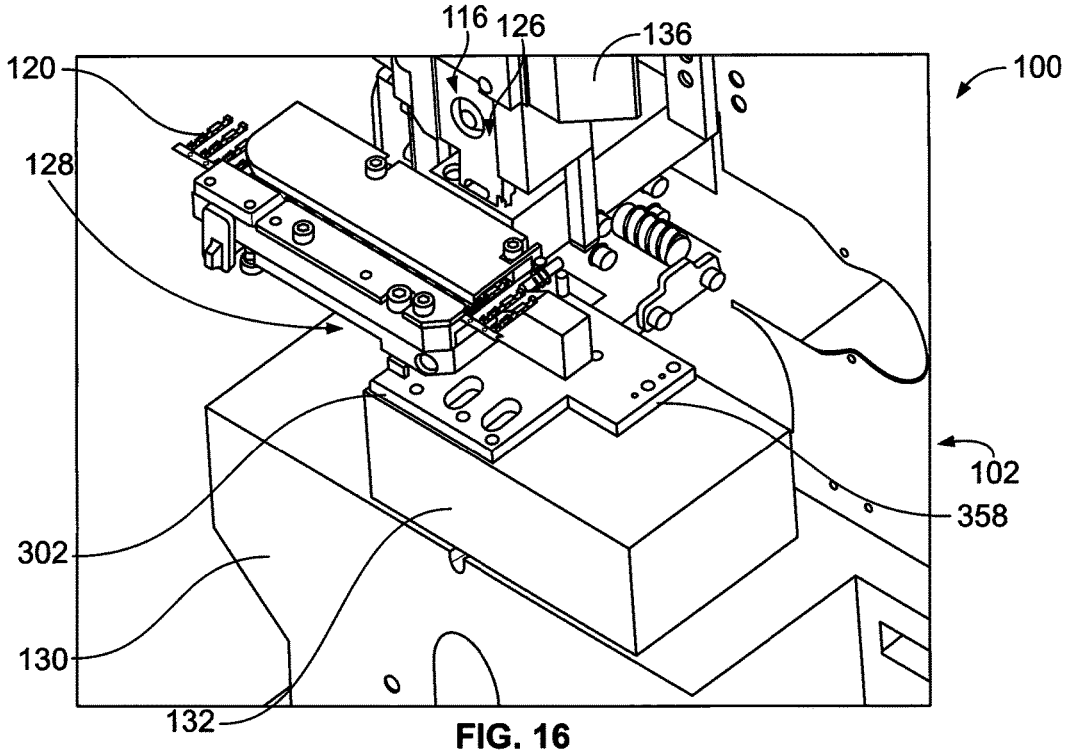
FIG. 16 illustrates a portion of the terminal crimping machine showing.

FIG. 15 illustrates a portion of the terminal crimping machine 102 in accordance with an exemplary embodiment. FIG. 16 illustrates a portion of the terminal crimping machine 102 showing the upper tooling 126 positioned relative to the lower tooling assembly 128, with portions of the lower tooling 126 removed for clarity. For example, the upper plate 300 (FIG. 15) is removed to illustrate the lower plate 302, which is configured to be coupled to the terminal crimping machine 102, such as to the base 132 of the terminator frame 130. In an exemplary embodiment, the lower plate 302 may be releasably coupled to the base 132. When it is desired to remove the crimp tooling 100 from the terminal crimping machine 102, such as when the terminal crimping machine 102 is needed for terminating a different type or size of terminal, the crimp tooling 100 is configured to be removed from the terminal crimping machine 102. The upper tooling 126 is removed from the terminator ram 136 and coupled to the lower tooling assembly 128. The lower tooling assembly 128 is removed from the terminator frame 130, such as by releasing the lower tooling assembly 128 from the terminator frame 130.

FIG. 15 shows the terminator ram 136 with the cover 254 partially removed to illustrate the plug chamber 252. When the upper tooling 126 is assembled to the terminator ram 136, the plug 220 of the wire crimper holder 142 is received in the plug chamber 252. The alignment surfaces 260 of the terminator ram 136 engage the alignment surfaces 230, 232 of the wire crimper holder 142. The bottom 258 of the terminator ram 136 abuts against the first and second press surfaces 242, 244. The upper tooling 126 is configured to be releasably secured to the terminator ram 136.

As the terminator ram 136 is raised and lowered during the crimping process, the terminator ram 136 drives the upper tooling 126 downward to crimp the terminal 120 to the wire 122. For example, the bottom 258 of the terminator ram 136 drives against the press surfaces 242, 244. The alignment surfaces 230, 232 maintain side to side position of the upper tooling 126 relative to the terminator ram 136 during the crimping process. After bottom dead center, the terminator ram 136 lifts the upper tooling 126 upward away from the anvil 150.

Upon completion of use of the terminal crimping machine 102, the upper tooling 126 may be removed from the terminator ram 136 and stored with the lower tooling assembly 128. For example, the support member 144 may be coupled to the support member 158 to secure the upper tooling 126 to the lower tooling assembly 128 for storage. The plug 220 is released from the plug chamber 252. The support member 144 may then be received in the opening 362 and the housing 360 of the support member 158 to store the upper tooling 126 with the lower tooling assembly 128.

Figure 17:
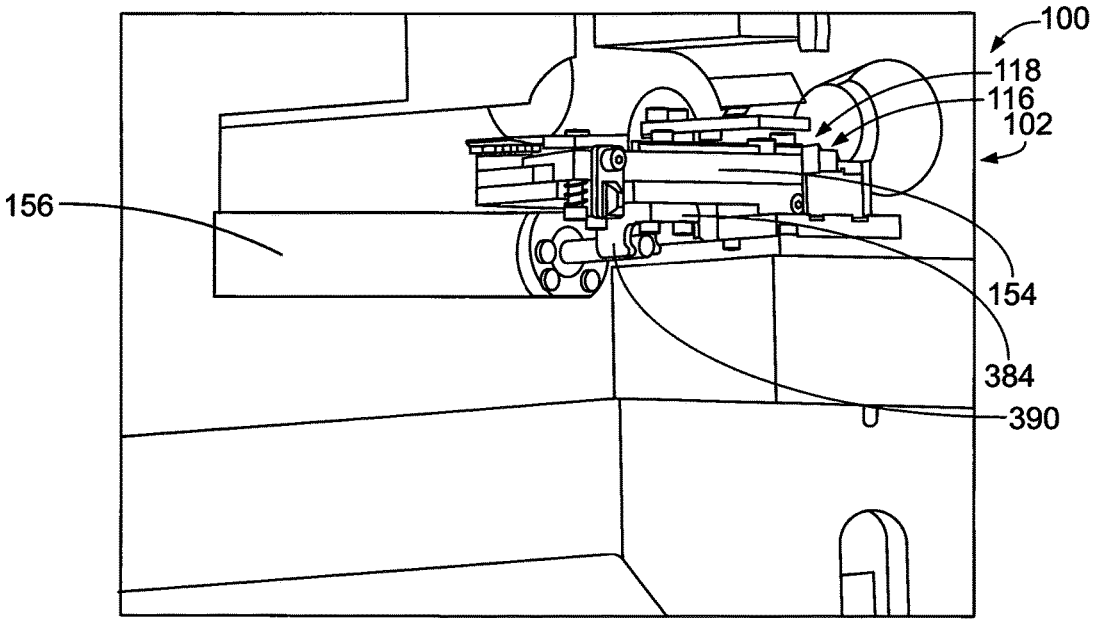
FIG. 17 illustrates the lower tooling assembly interface with the feed mechanism.

FIG. 17 illustrates the lower tooling assembly interface with the feed mechanism of the terminal crimping machine 102 in accordance with an exemplary embodiment. FIG. 17 shows the feed mechanism 156 coupled to the terminal guide 154. The feed mechanism 156 is coupled to the mounting bracket 390. As the feed mechanism 156 is operated, the feed slide 384 is advanced forward to advance the terminal to the crimping zone 118. The feed mechanism 156 may be detached from the mounting bracket 390 to remove the crimp tooling 100 from the terminal crimping machine 102. The feed mechanism 156 remains integrated with the terminal crimping machine 102 and positioned to accept the next set of crimp tooling 100.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. Crimp tooling for a terminal crimping machine for crimping a terminal to a wire, the crimp tooling comprising:

a lower tooling assembly configured to be coupled to a terminator frame of the terminal crimping machine, the lower tooling assembly configured to support the terminal during crimping, the lower tooling assembly comprising a base having a plate and an anvil supported by the plate, the plate being removably coupled to the terminator frame, the base supporting a terminal guide used to guide terminals to the anvil; and upper tooling configured to be coupled to a terminator ram of the terminal crimping machine supported by the terminator frame, the upper tooling configured to form the terminal around the wire during crimping, the upper tooling comprising a wire crimper and a wire crimper holder for holding the wire crimper;

the wire crimper having a main body and first and second legs extending from the main body, the first and second legs provided on opposite sides of a crimp slot configured to receive the terminal and having a crimp profile configured to form the terminal during crimping, the wire crimper being operably associated with the anvil to form the terminal during crimping;

the wire crimper holder having a top end and a bottom end, the wire crimper holder having a front and a rear, the wire crimper holder having a first side and a second side, the wire crimper holder having a pocket at the bottom end, the pocket receiving the main body of the wire crimper, the wire crimper being secured to the wire crimper holder in the pocket such that the legs extend below the bottom end to engage the terminal, the wire crimper holder having a first press surface at the first side and a second press surface at the second side, the wire crimper holder having a first alignment surface at the first side and a second alignment surface at the second side, the wire crimper holder including a plug above the first and second press surfaces, the plug including the first and second alignment surfaces, the plug being configured to be plugged into a plug chamber of the terminator ram such that the first and second alignment surfaces engage the terminator ram to hold a side-to-side position of the wire crimper holder relative to the terminator ram, the first and second press surfaces engage the terminator ram and are configured to be pressed downward by the terminator ram during crimping, the plug being configured to be releasably fixed to the terminator ram in the plug chamber.

2. The crimp tooling of claim 1, wherein a position of the wire crimper holder is controlled by the terminator ram.

3. The crimp tooling of claim 1, wherein the first and second alignment surfaces are angled nonparallel to a movement axis of the upper tooling.

4. The crimp tooling of claim 1, wherein the wire crimper holder includes a fastener engaging the wire crimper for positioning the wire crimper in the pocket, the wire crimper being vertically positionable relative to the fastener.

5. The crimp tooling of claim 1, wherein the wire crimper holder includes a fastener securing the wire crimper in the pocket, the first and second alignment surfaces being located a predetermined vertical distance relative to the fastener to control a crimp height of the wire crimper relative to the termination tool.

6. The crimp tooling of claim 1, wherein the wire crimper is variably positionable in the pocket of the wire crimper holder to adjust a crimp height of the wire crimper.

7. The crimp tooling of claim 1, wherein the first and second press surfaces are located immediately below the terminator ram.

8. The crimp tooling of claim 1, wherein the plug includes a latching element configured to releasably engage the terminator ram to releasably couple the wire crimper holder to the terminator ram.

9. The crimp tooling of claim 1, wherein the wire crimper holder includes a support member extending therefrom remote from the wire crimper, the lower tooling assembly having a support member remote from the anvil that supports the upper tooling for storage of the upper tooling with the lower tooling assembly after the wire crimper holder is removed from the terminator ram.

10. The crimp tooling of claim 1, wherein the terminal guide is removably coupled to the plate, the terminal guide being aligned with the anvil.

11. The crimp tooling of claim 10, wherein the terminal guide includes a feed stop defining a hard stop for a feed slide of the terminal guide to limit movement of the feed slide in a retracting direction, wherein the feed stop is variably positionable along a guide mount of the terminal guide and adjusts the location of the mounting bracket thereby locating the feed mechanism on the terminal guide.

12. The crimp tooling of claim 1, wherein the plate includes a front, a rear, a first side and a second side, the anvil being fixed between the first and second sides and being adjustable between the front and the rear to adjust a front to rear position of the anvil relative to the wire crimper.

13. The crimp tooling of claim 1, wherein the plate includes a positioning slot receiving the anvil to position the anvil relative to the plate.

14. The crimp tooling of claim 1, further comprising a wire support forward of the anvil and a terminal support rearward of the anvil, the wire support and the terminal support being coupled to the plate.

15. The crimp tooling of claim 1, wherein the plate is an upper plate, the base further comprising a lower plate secured to the upper plate, the lower plate being removably coupled to the terminal crimping machine.

16. Crimp tooling for a terminal crimping machine for crimping a terminal to a wire, the crimp tooling comprising:

upper tooling configured to be coupled to a terminator ram of the terminal crimping machine supported by a terminator frame of the terminal crimping machine, the upper tooling configured to form the terminal around the wire during crimping, the upper tooling comprising a wire crimper and a wire crimper holder for holding the wire crimper, the wire crimper having a main body and first and second legs extending from the main body, the first and second legs provided on opposite sides of a crimp slot configured to receive the terminal and having a crimp profile configured to form the terminal during crimping, the wire crimper holder having a pocket at a bottom end of the wire crimper holder receiving the main body of the wire crimper, the wire crimper being secured to the wire crimper holder in the pocket, the wire crimper holder being configured to be releasably fixed to a terminator ram, the wire crimper holder being directly coupled to and driven by the terminator ram and being removable from the terminator ram, the wire crimper holder having a support member extending therefrom remote from the wire crimper; and a lower tooling assembly configured to be coupled to the terminator frame of the terminal crimping machine, the lower tooling assembly configured to support the terminal during crimping, the lower tooling assembly having lower tooling including an anvil having a cradle for supporting the terminal, the lower tooling assembly having a support member remote from the cradle that supports the upper tooling for storage of the upper tooling with the lower tooling assembly after the wire crimper holder is removed from the terminator ram.

17. The crimp tooling of claim 16, wherein a position of the wire crimper holder is controlled by the terminator ram.

18. The crimp tooling of claim 16, wherein the wire crimper holder includes a plug at a top end thereof configured to be plugged into a plug chamber of the terminator ram.

19. The crimp tooling of claim 18, wherein the plug includes first and second alignment surfaces, the plug is configured to be plugged into the plug chamber such that the first and second alignment surfaces engage the terminator ram to hold a side-to-side position of the wire crimper holder relative to the terminator ram.

20. The crimp tooling of claim 18, wherein the wire crimper holder includes press flanges extending from the first and second sides of the wire crimper holder below the plug, the press flanges include first and second press surfaces, the plug extending above the press flanges, the first and second press surfaces engage the terminator ram and are configured to be pressed downward by the terminator ram during crimping.

21. The crimp tooling of claim 16, further comprising a terminal guide coupled to a plate of the lower tooling assembly, the terminal guide being aligned with the anvil, the terminal guide being removable from the terminal crimping machine with the lower tooling assembly.

22. The crimp tooling of claim 21, wherein the plate includes a front, a rear, a first side and a second side, the anvil being fixed between the first and second sides and being adjustable between the front and the rear to adjust a front to rear position of the anvil relative to the wire crimper.

23. Crimp tooling for a terminal crimping machine for crimping a terminal to a wire, the crimp tooling comprising:

upper tooling configured to be coupled to a terminator ram of the terminal crimping machine supported by a terminator frame of the terminal crimping machine, the upper tooling configured to form the terminal around the wire during crimping, the upper tooling comprising a wire crimper and a wire crimper holder for holding the wire crimper, the wire crimper holder being removably coupled directly to a terminator ram of a terminal crimping machine and being driven by the terminator ram; and a lower tooling assembly configured to be coupled to a terminator frame of the terminal crimping machine, the lower tooling assembly configured to support the terminal during crimping, the lower tooling assembly comprising a base having a plate and an anvil supported by the plate, the base being removably coupled directly to the terminal crimping machine; and a terminal guide coupled to the plate, the terminal guide being aligned with the anvil, the terminal guide being removable from the terminal crimping machine with the lower tooling assembly.

24. The crimp tooling of claim 23, wherein the terminal guide includes a feed slide having a feed finger configured to engage the terminal to advance the terminal, the feed slide being positioned below the terminal.

25. The crimp tooling of claim 23, wherein the plate includes a front, a rear, a first side and a second side, the plate having a first slot at a top of the plate and a second slot at a top of the plate, the first and second slots being parallel to each other and being parallel to the first and second sides, the first slot receiving the anvil and holding a side to side position of the anvil, the second slot receiving the terminal guide and holding a side to side position of the terminal guide, fasteners extending through the plate to secure the anvil to the plate and the terminal guide to the plate in the first and second slots, respectively.

26. The crimp tooling of claim 23, wherein the terminal guide includes a feed stop defining a hard stop for a feed slide of the terminal guide to limit movement of the feed slide in a retracting direction.

27. The crimp tooling of claim 26, wherein the feed stop is variably positionable along a guide mount of the terminal guide.

28. The crimp tooling of claim 23, wherein the upper tooling includes a support member extending from the wire crimper holder remote from the wire crimper, the lower tooling assembly having a support member remote from the anvil configured to be coupled to the support member of the upper tooling, the support member of the lower tooling assembly supporting the upper tooling for storage of the upper tooling with the lower tooling assembly after the wire crimper holder is removed from the terminator ram.

* * * * *